US011041662B2

(12) United States Patent
Choi

(10) Patent No.: US 11,041,662 B2
(45) Date of Patent: Jun. 22, 2021

(54) INSTANTANEOUS WATER HEATER HAVING GUIDE PORTION

(71) Applicant: Young-Hwan Choi, Seoul (KR)

(72) Inventor: Young-Hwan Choi, Seoul (KR)

( * ) Notice: Subject to any disclaimer, the term of this patent is extended or adjusted under 35 U.S.C. 154(b) by 111 days.

(21) Appl. No.: 16/683,790

(22) Filed: Nov. 14, 2019

(65) Prior Publication Data

US 2020/0116390 A1 Apr. 16, 2020

Related U.S. Application Data

(63) Continuation of application No. PCT/KR2018/012465, filed on Oct. 22, 2018.

(30) Foreign Application Priority Data

Jan. 4, 2018 (KR) ..... 10-2018-0001072

(51) Int. Cl.
*F24H 9/00* (2006.01)
*F24H 1/20* (2006.01)
*F24H 9/02* (2006.01)

(52) U.S. Cl.
CPC ..... *F24H 9/0015* (2013.01); *F24H 1/20* (2013.01); *F24H 9/02* (2013.01)

(58) Field of Classification Search
CPC ..... F24H 9/0015; F24H 1/20
See application file for complete search history.

(56) References Cited

U.S. PATENT DOCUMENTS 3,446,939 A * 5/1969 Lowe ..... F24H 1/20 392/452
6,321,036 B1 11/2001 Huang
9,316,412 B2 * 4/2016 Giamati ..... F24H 9/126
2014/0086566 A1 * 3/2014 Waechter ..... F24H 1/009 392/479

FOREIGN PATENT DOCUMENTS

KR 10-2006-0022379 A 3/2006
KR 10-2008-0033953 A 4/2008
KR 10-1314997 B1 10/2013
KR 10-1789937 B1 10/2017
KR 10-1947778 B1 2/2019

OTHER PUBLICATIONS

Nternational Search Report issued in PCT/KR2018/012465; dated Feb. 8, 2019.

* cited by examiner

*Primary Examiner* — Nathaniel Herzfeld
(74) *Attorney, Agent, or Firm* — Studebaker & Brackett PC

(57) ABSTRACT

The present invention relates to an instantaneous water heater having a guide part. The instantaneous water heater having the guide part is configured to allow direct water to stay around a heater for a long time, so that direct water is efficiently heated into hot water at a preset temperature desired by a user.

7 Claims, 7 Drawing Sheets

INSTANTANEOUS WATER HEATER HAVING GUIDE PORTION

CROSS-REFERENCE TO RELATED APPLICATIONS

This application is a Continuation of International Application No. PCT/KR2018/012465 filed Oct. 22, 2018, which claims benefit of priority to Korean Patent Application No. 10-2018-0001072 filed Jan. 4, 2018, the entire content of which is incorporated herein by reference.

TECHNICAL FIELD

The present invention relates to an instantaneous water heater having a guide part. More particularly, the present invention relates to an instantaneous water heater having a guide part capable of allowing direct water to stay around a heater for a long time to efficiently heat direct water into hot water at a preset temperature desired by a user.

BACKGROUND ART

Generally, most water heaters provide hot water for shower and washing face in homes or offices by a method of storing a certain amount of water in a storage tank and using gas or electricity as a heat source. Water heaters include a storage water heater, which always stores a certain amount of water in a storage tank for hot water supply, and an instantaneous water heater which has higher energy efficiency.

The instantaneous water heater has relatively small size, long durability, continuous flow of hot water, and low energy consumption in comparison with the storage-type water heater. Furthermore, in the instantaneous water heater, low or not stand-by energy is required to preheat water and maintain the proper temperature of hot water, and a water supply tube is relatively short, so there is little heat loss in the water supply tube.

FIG. 1 is a sectional view showing a conventional instantaneous water heater. Referring to FIG. 1, the conventional electric instantaneous water heater includes an external casing 10, a water tank 20 provided inside the external casing 10, a heater 30 positioned inside the water tank 20. An inlet tube 21 through which cold water is introduced and an outlet tube 23 through which hot water is discharged are connected to opposite sides of a lower portion of the water tank 20, respectively. The cold water introduced into the water tank 20 through the inlet tube 21 is heated by the heater 30 to hot water. The hot water flows over the water tank 20 by the convection of heat and then is introduced into the outlet tube 23.

The heater 30 of the conventional electric water heater is formed in a horizontal direction, so that hot water heated by the heater 30 may not be in contact with the heater 30 for a long time. Therefore, the conventional electric water heater has a problem that the temperature of hot water is lower than a preset temperature desired by a user.

DISCLOSURE

Technical Problem

Accordingly, the present invention has been made keeping in mind the above problems occurring in the prior art, and an object of the present invention is to provide an instantaneous water heater having a guide part capable of allowing direct water to stay around a heater for a long time to efficiently heat direct water into hot water at a preset temperature desired by a user.

Technical Solution

In order to accomplish the above object, the present invention provides an instantaneous water heater having a guide part. The instantaneous water heater includes: a housing having a space part therein, the housing having an inlet and an outlet provided at a lower portion thereof, respectively; a supply tube configured as a vertically long tube, the supply tube being provided at a center portion of the space part in a vertical direction, and configured such that a lower end thereof is connected to the outlet; a blocking member, wherein a pair of blocking plates is arranged at an upper portion and a lower portion of the space part by being spaced apart from each other and is configured such that the supply tube passes therethrough, a plurality of partition plates is arranged radially around the supply tube, which is positioned between the pair of blocking plates, in directions toward an inner circumferential surface of the housing, the plurality of partition plates being configured such that upper and lower ends thereof are connected perpendicularly to the pair of blocking plates, and a guide plate is provided between a pair of adjacent partition plates to be parallel with the blocking plates; and a heater positioned in a space between a pair of adjacent partition plates and configured to pass through the guide plate. Wherein the pair of blocking plates may include a lower blocking plate positioned in the lower portion of the space part and an upper blocking plate positioned above the lower blocking plate, when direct water is introduced through the inlet that is positioned between a lower end of the housing and the lower blocking plate, the direct water may be heated into hot water while passing through a first partitioned area between the lower blocking plate and the guide plate and a second partitioned area between the guide plate and the upper blocking plate, sequentially, and then the direct water may be guided to an upper end of the supply tube that may be positioned between the upper blocking plate and an upper end of the housing.

The guide plate may include; a center portion through which the supply tube passes; and a plurality of protruding plates extending radially outwards from the center portion in the directions toward the inner circumferential surface of the housing, the guide plate being configured such that the partition plates may pass through the protruding plates, and a recessed guide groove may be formed between a pair of adjacent protruding plates to guide the heater.

Further, the instantaneous water heater may include: a cylindrical cover tube provided to cover an outer circumferential surface of the supply tube that is positioned between the upper and lower blocking plates. Wherein an upper end of the cover tube may be connected to the upper blocking plate and a lower end of the cover tube may be connected to the lower blocking plate, an inner side of each of the partition plates facing the cover tube may be connected to the cover tube and an outer side of each of the partition plates facing the inner circumferential surface of the housing may be connected to the housing, a plurality of movement guide holes may be formed on the upper blocking plate, and a coupling hole may be formed on the lower blocking plate, with an area of the coupling hole being larger than a cross-sectional area of the heater so that the heater may be inserted thereinto.

A plurality of protrusions may be formed around an upper circumference of the supply tube by protruding and may be configured such that upper ends of the protrusions may be coupled to the upper end of the housing, and hot water introduced into a space between the upper blocking plate and the upper end of the housing may be guided to an inside of the supply tube through a supply portion positioned between adjacent protrusions.

Further, the housing having open upper and lower portions may include: upper and lower covers configured to cover the open upper and lower portions, respectively; and a sliding rail provided on the inner circumferential surface of the housing such that when the plurality of partition plates is inserted into the housing having the open upper or lower portion, an outer side of each of the plurality of partition plates that may face the inner circumferential surface of the housing may be slidingly inserted into the housing by being engaged with the sliding rail.

Further, the housing having open upper and lower portions may include: upper and lower covers configured to cover the open upper and lower portions, respectively; and an upper locking protrusion and a lower locking protrusion formed by protruding on the inner circumferential surface of the housing at a position facing an upper outer circumference of the upper blocking plate and at a position facing a lower outer circumference of the lower blocking plate, so that, when the upper and lower blocking plates are inserted into the housing having the open upper or lower portion, the upper blocking plate may be locked by the upper locking protrusion and the lower blocking plate may be locked by the lower locking protrusion.

Further, the housing having open upper and lower portions may include an upper cover and a lower cover configured to cover the open upper and lower portions, respectively, the lower cover may include an insertion guide hole at a position facing the heater, and the heater may include: a plurality of heating tubes positioned in a space between a pair of partition plates and formed in upside-down U-shapes; and a coupling plate positioned to cover the insertion guide hole and configured such that ends of the heating tubes may be inserted thereinto.

Advantageous Effects

As described above, the instantaneous water heater having the guide part of the present invention is provided with the guide plate between the pair of blocking plates, so that the space between the pair of blocking plates is partitioned into the first partitioned area and the second partitioned area. Accordingly, low temperature water is heated into middle temperature water by staying in the first partitioned area and then the middle temperature water is heated into high temperature water by staying in the second partitioned area, so direct water can be heated to create hot water at the temperature desired by the user.

DESCRIPTION OF REFERENCE NUMERALS

Figure 1:
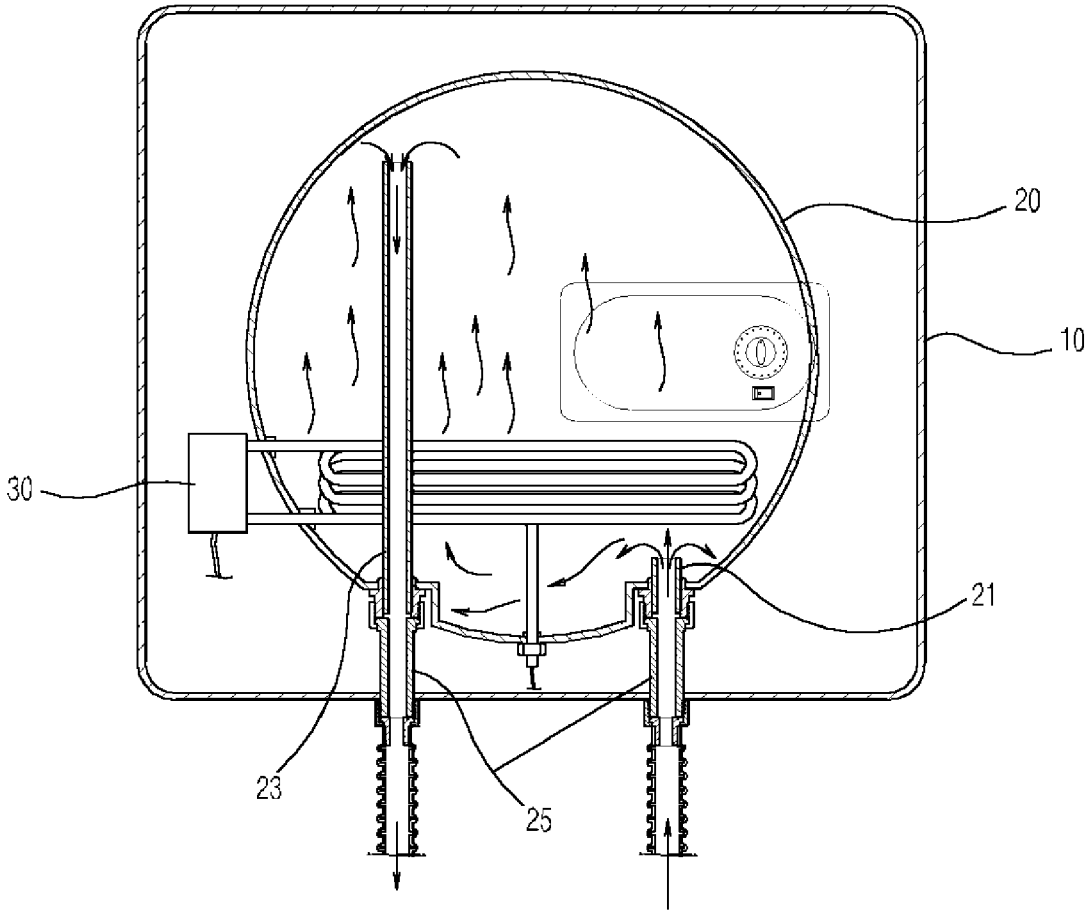
FIG. 1 is a sectional view showing a conventional instantaneous water heater.

1000: instantaneous water heater having guide part
100: housing 110: main body
112: space part 114: sliding rail
116: upper locking protrusion
118: lower locking protrusion
120: lower cover 122: through hole
124: insertion guide hole 130: upper cover
132: protrusion guide hole 140: inlet
142: inlet tube 150: outlet
152: outlet tube 200: supply tube
210: protrusion 212: supply portion
300: blocking member 310: lower blocking plate
312: coupling hole 320: upper blocking plate
322: movement guide hole 330: cover tube
340: partition plate 350: guide plate
352: center portion 352*a*: center hole
354: protruding plate 356: guide groove
400: heater 410: heating tube
420: coupling plate

BEST MODE

Hereinbelow, an instantaneous water heater having a guide part according to an exemplary embodiment of the present invention will be described in detail with reference to the accompanying drawings.

Figure 2:
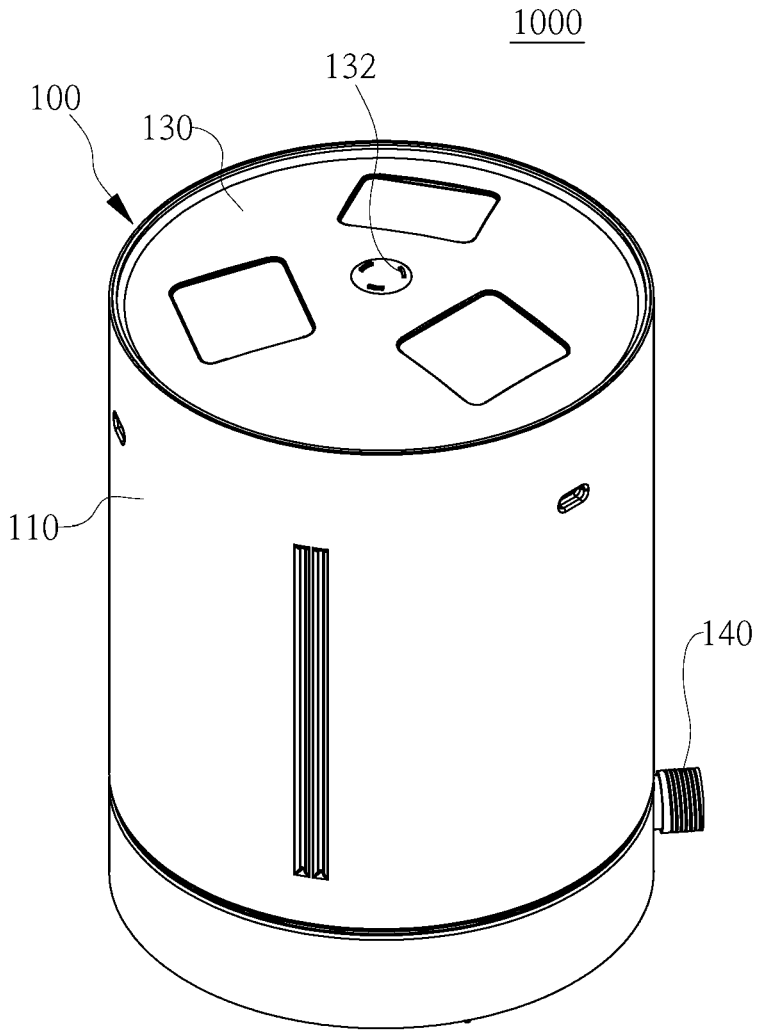
FIG. 2 is a view showing an instantaneous water heater having a guide part according to an exemplary embodiment of the present invention.
Figure 3:
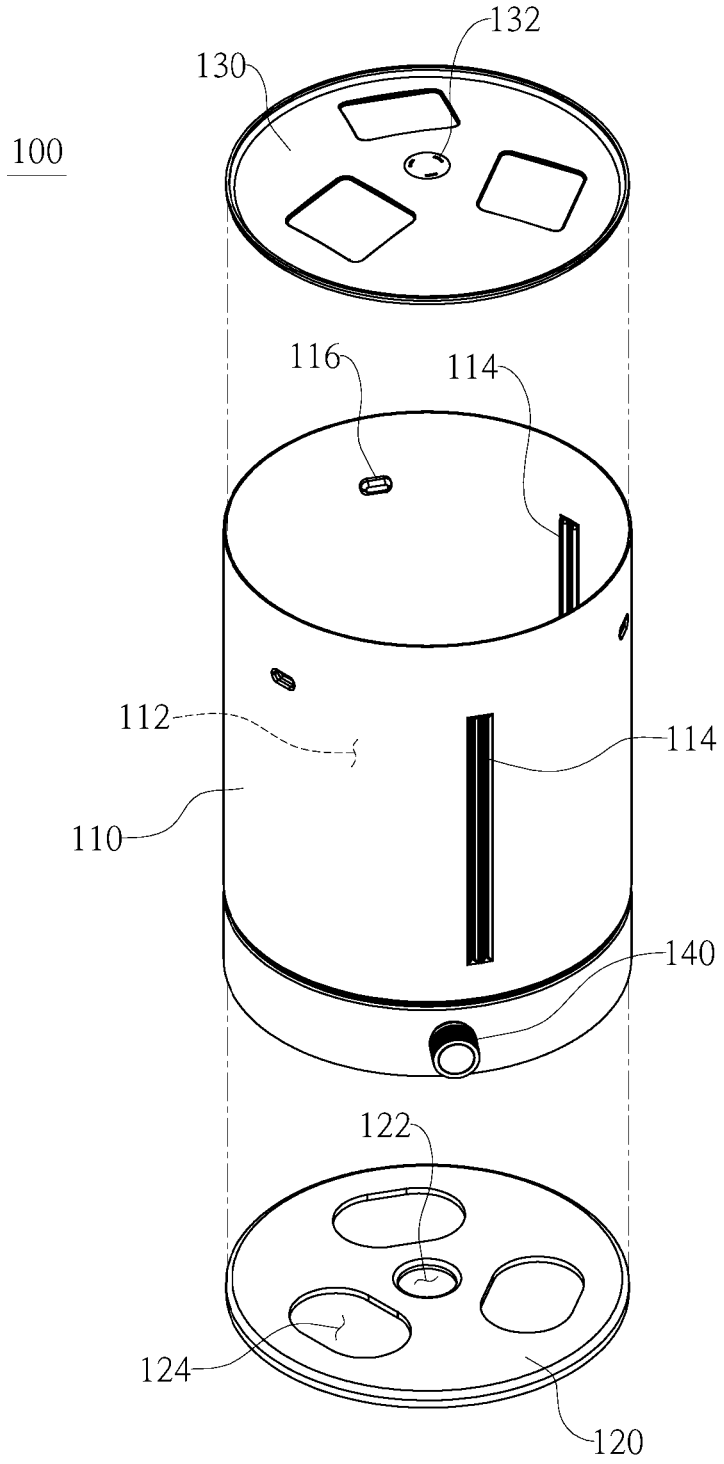
FIG. 3 is a view showing the instantaneous water heater having the guide part according to the exemplary embodiment of the present invention, wherein a housing of the instantaneous water heater is disassembled.

FIG. 2 is a view showing an instantaneous water heater having a guide part according to an exemplary embodiment of the present invention; and FIG. 3 is a view showing the instantaneous water heater having the guide part according to the exemplary embodiment of the present invention, wherein a housing of the instantaneous water heater is disassembled.

Figure 4:
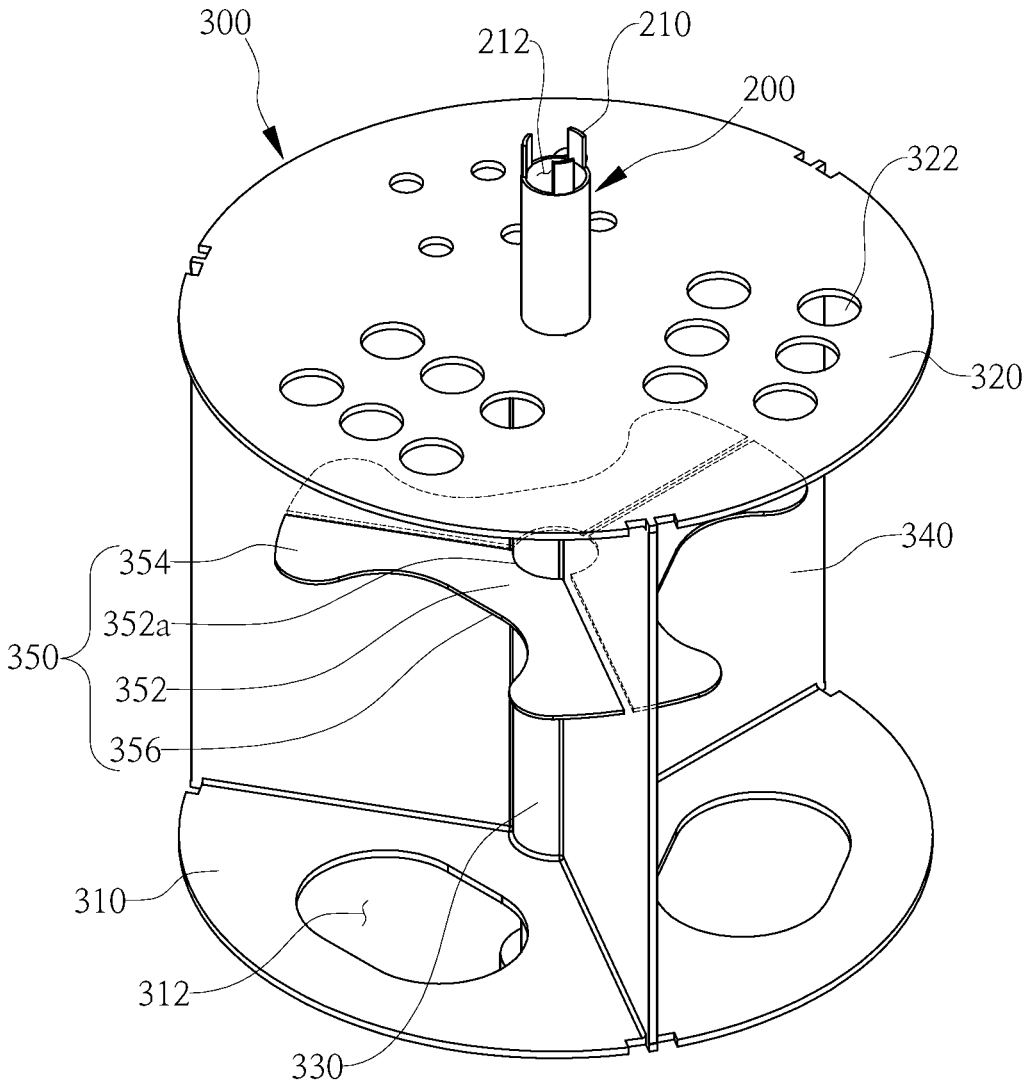
FIG. 4 is a view showing a supply tube and a blocking member of the instantaneous water heater having the guide part according to the exemplary embodiment of the present invention.
Figure 5:
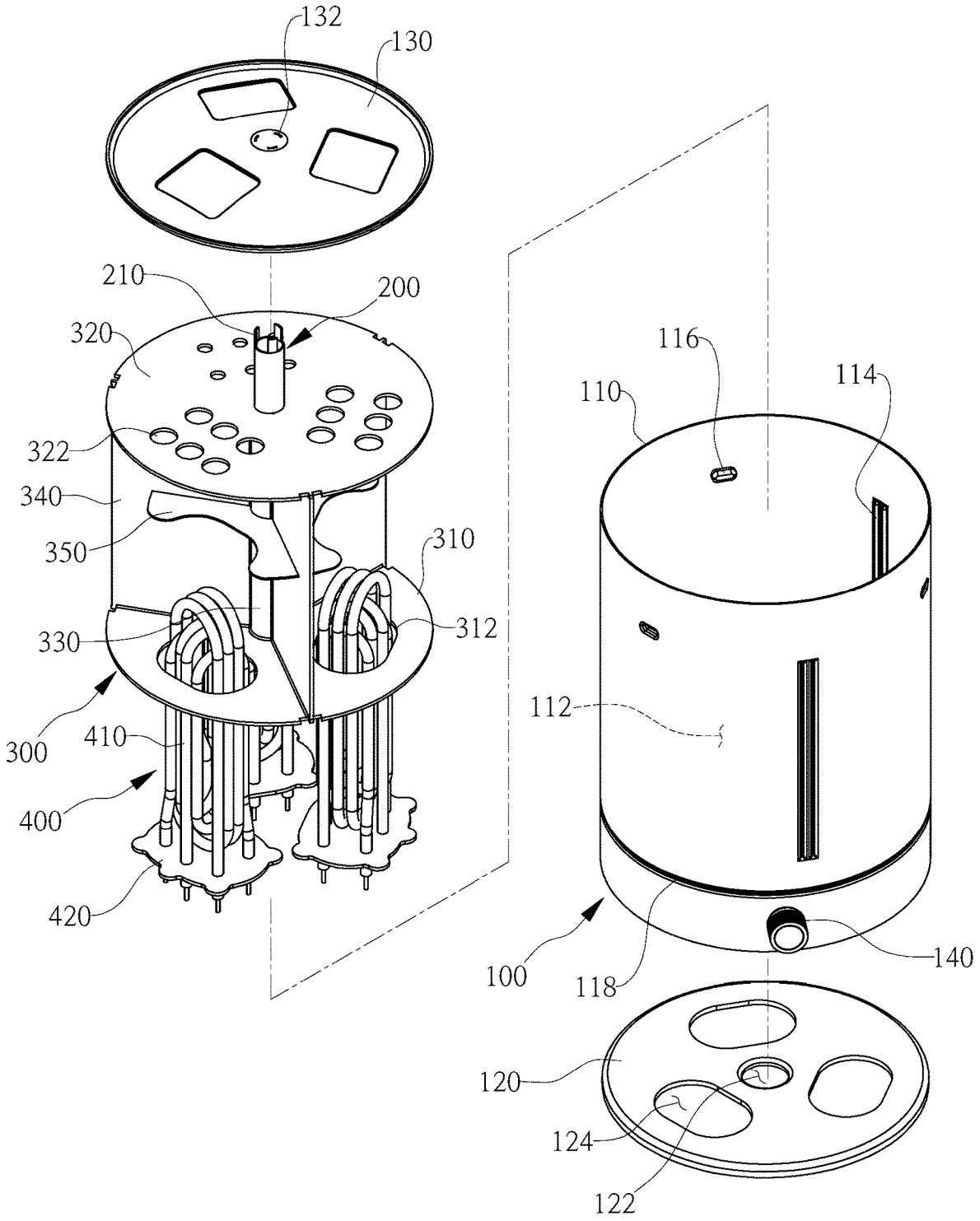
FIG. 5 is a view showing an exploded state of the instantaneous water heater having the guide part according to the exemplary embodiment of the present invention.

Referring to FIGS. 2 and 3, according to the exemplary embodiment of the present invention, the instantaneous water heater 1000 having the guide part includes the housing 100, a supply tube 200 (shown in FIG. 4), a blocking member 300 (shown in FIG. 4), and a heater 400 (shown in FIG. 5).

The housing 100 may be provided with a space part 112 to store water therein and may be made of a material facilitating thermal insulation from the outside of the housing. The housing 100 includes: a cylindrical main body 110 having the space part 112 therein, and an open upper portion and a lower portion; and a circular upper cover 130 hermetically covering the open upper portion of the main body 110 and a lower cover 120 hermetically covering the open lower portion of the main body 110. The upper cover 130 may have an arc sectional shape to easily endure expansion pressure from steam generated from hot water when direct water introduced into the main body 110 is heated to create hot water. The upper cover 130 has protrusion guide holes 132 that are formed through the upper cover at positions facing a plurality of protrusions 210 (shown in FIG. 4) as will be described later herein, so that upper ends of the protrusions 210 are inserted thereinto. The lower cover 120 has a through hole 122 at the center thereof, so that the supply tube 200 is inserted thereinto as will be described later herein. In addition, the lower cover 120 has an insertion guide hole 124 at a position facing a coupling hole 312 (shown in FIG. 4).

The main body 110 has an inlet 140 at a lower outer circumference surface thereof, and an outlet 150 is provided in the through hole 122 of the lower cover 120. The inlet 140 is configured such that direct water, that is, water from the outside of the housing 100, is introduced into the space part 112 of the main body 110. The outlet 150 is configured such that hot water supplied through the supply tube 200 that will be described later herein is discharged to the outside of the housing 100. In addition, the lower cover 120 may have a drain part (now shown) to discharge water stored in the space part 112 to the outside for cleaning, maintenance, and the like.

FIG. 4 is a view showing a supply tube and a blocking member of the instantaneous water heater having the guide part according to the exemplary embodiment of the present invention; and FIG. 5 is a view showing an exploded state of the instantaneous water heater having the guide part according to the exemplary embodiment of the present invention.

Referring to FIGS. 4 and 5, according to the exemplary embodiment of the present invention, the instantaneous water heater 1000 having the guide part is configured such that the blocking member 300 to which the supply tube 200 and the heater 400 are coupled is inserted into the main body 110 of the housing 100.

The supply tube 200 is formed as a vertically long tube at the center of the space part 112 in a vertical direction thereof, and is configured such that a lower end of the supply tube is connected to the outlet 150 and an upper end thereof is connected to the upper cover 130. The supply tube 200 has the plurality of protrusions 210 formed by protruding upwards on an upper circumference of the supply tube, and a supply portion 212 that is an empty space is positioned between a pair of adjacent protrusions 210. The upper ends of the protrusions 210 are inserted into the protrusion guide holes 132 of the upper cover 130. Hot water introduced into a position between an upper blocking plate 320 that will be described later herein and the upper cover 130 is guided into the inside of the supply tube 200 through the supply portion 212 between the protrusions 210 adjacent to each other.

The blocking member 300 includes blocking plates, partition plates 340, and a guide plate 350. The blocking plates are provided as a pair of blocking plates by being spaced apart from each other at an upper portion and a lower portion of the space part 112 of the main body 110. The blocking plates consist of the upper blocking plate 320 inserted into the upper portion of the space part 112 of the main body 110 and a lower blocking plate 310 inserted into the lower portion of the space part 112 of the main body 110. When the upper blocking plate 320 and the lower blocking plate 310 are inserted into the space part 112 of the main body 110, outer circumferential surfaces of the upper blocking plate 320 and the lower blocking plate 310 are in close contact with the inner circumferential surface of the main body 110. The supply tube 200 integrally passes through center portions of the upper blocking plate 320 and the lower blocking plate 310. The blocking member 300 may include a cylindrical cover tube 330 configured to cover an outer circumference surface of the supply tube 200 positioned between the upper blocking plate 320 and the lower blocking plate 310. An upper end of the cover tube 330 is connected to the upper blocking plate 320 and a lower end of the cover tube 330 is connected to the lower blocking plate 310.

The partition plates 340 may be formed as rectangular plates. A plurality of partition plates 340 is arranged radially around the cover tube 330 positioned between the upper blocking plate 320 and the lower blocking plate 310 in directions toward the inner circumferential surface of the main body 110. Upper and lower ends of the partition plates 340 are connected perpendicularly to the upper blocking plate 320 and the lower blocking plate 310, respectively. Inner sides of the partition plates 340 facing the cover tube 330 are connected to the cover tube 330, and outer sides of the partition plates 340 facing the inner circumferential surface of the main body 110 are connected to the inner circumferential surface of the main body 110.

The guide plate 350 is provided between a pair of adjacent partition plates 340 to be parallel with the upper blocking plate 320 or with the lower blocking plate 310. The guide plate 350 includes: a center portion 352, the center portion being provided with a center hole 352*a* so that the supply tube 200 passes therethrough; and a plurality of protruding plates 354 extending radially outwards from the center portion 352 in directions toward an inner circumference surface of the housing 100. The guide plate 350 is configured such that the partition plates 340 pass through the protruding plates 354, and a recessed guide groove 356 is formed between the pair of adjacent protruding plates 354 so that the heater 400 that will be described later herein is guided thereinto. Accordingly, hot water raised from the lower blocking plate 310 to the upper blocking plate 320 is partially blocked by the guide plate 350, thus the hot water may be in contact with the heater 400 for a long time. This operation will be described again in FIG. 7.

The heater 400 creates hot water by heating direct water introduced into the main body 110. For example, the heater 400 includes: a plurality of heating tubes 410 positioned in a space between the pair of partition plates 340 and formed in an upside-down U-shape; and a coupling plate 420 positioned to cover the insertion guide hole 124 and into which ends of the heating tubes 410 are inserted. The heating tubes 410 may be provided as one or a plurality of heating tubes on the basis of a preset temperature of hot water. When the coupling plate 420 is fitted into the insertion guide hole 124, the heating tubes 410 pass through the insertion guide hole 124 and the coupling hole 312 sequentially, then are positioned between the lower blocking plate 310 and the upper blocking plate 320. At this point, side portions of the heating tubes 410 are positioned to face the guide groove 356 of the guide plate 350.

Figure 6:
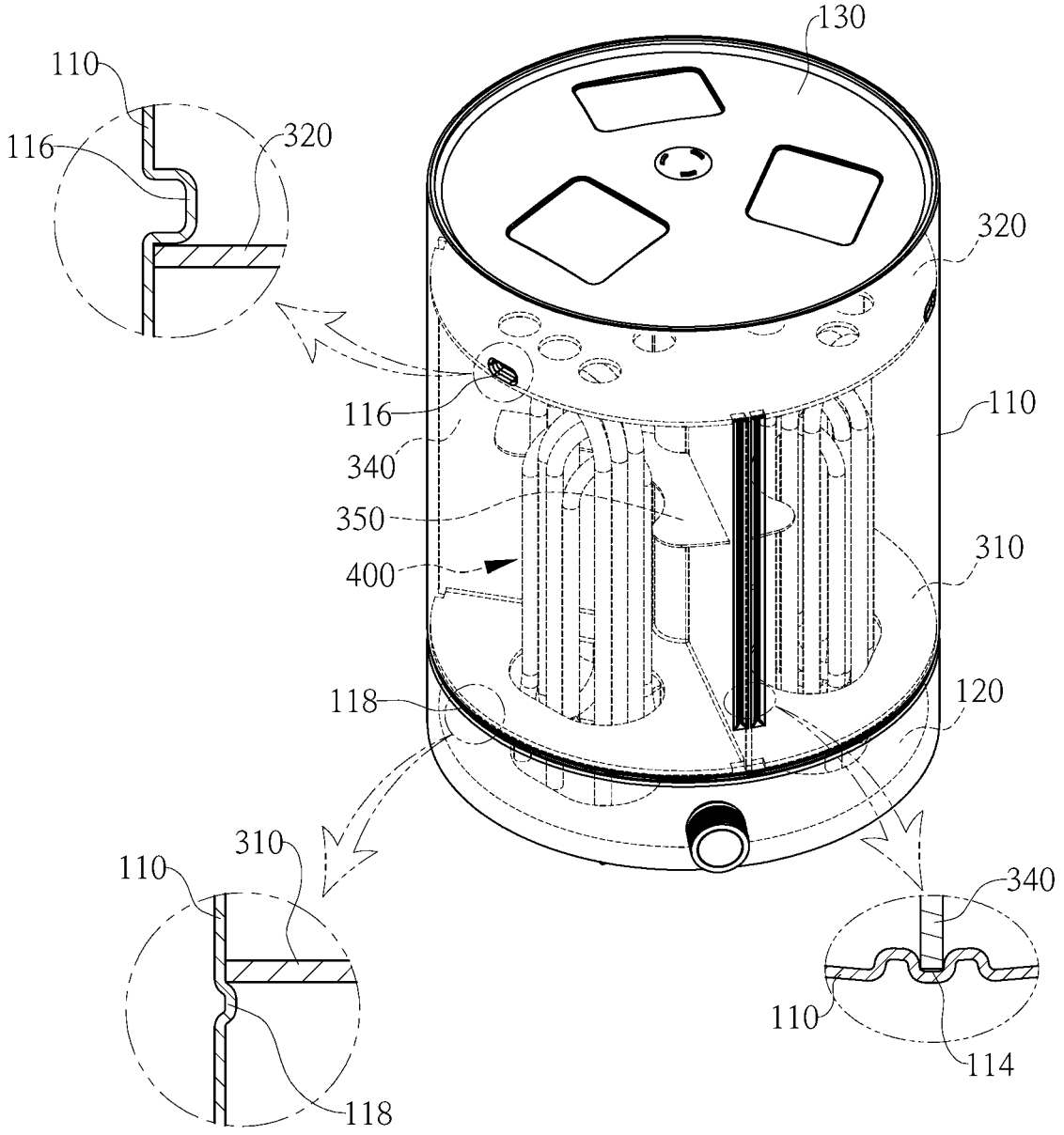
FIG. 6 is a view showing the inside of the instantaneous water heater having the guide part according to the exemplary embodiment of the present invention, the instantaneous water heater being in an assembled state.

FIG. 6 is a view showing the inside of the instantaneous water heater having the guide part according to the exemplary embodiment of the present invention, the instantaneous water heater being in an assembled state.

Referring to FIGS. 5 and 6, an assembly structure of the instantaneous water heater 1000 having the guide part according to the exemplary embodiment of the present invention is shown in the drawings. First, after the supply tube 200 passes through the blocking member 300, the blocking member 300 is inserted into the space part 112 through the open upper portion of the main body 110. On the inner circumferential surface of the main body 110, an upper locking protrusion 116 protrudes at a position facing an upper outer circumference of the upper blocking plate 320 so that the upper blocking plate 320 is locked thereto, and a lower locking protrusion 118 protrudes at a position facing a lower outer circumference of the lower blocking plate 310 so that the lower blocking plate 310 is locked thereto. A plurality of upper locking protrusions 116 is spaced apart from each other on the inner circumferential surface of the main body 110 and may be formed by a caulking method. The lower locking protrusion 118 is formed in a ring by protruding on the inner circumferential surface of the main body 110. In addition, a sliding rail 114 is provided on the inner circumferential surface of the main body 110 such that when the blocking member 300 is inserted into the main body 110, each of the outer sides of the partition plates 340 that faces the inner circumferential surface of the main body 110 is slidingly inserted into the main body 110 by being engaged with the sliding rail. Likewise, as the main body 110 of the instantaneous water heater of the present invention includes the upper locking protrusion 116, the lower locking protrusion 118, and the sliding rail 114, the blocking member 300 inserted in the main body 110 may be guided into the main body 110 and firmly coupled to the main body 110. Furthermore, when the blocking member 300 is inserted into the main body 110, the upper cover 130 and the lower cover 120 are coupled to the upper and lower portions of the main body 110, respectively. Then, the heating tubes 410 passing through the insertion guide hole 124 and the coupling hole 312 are positioned between the lower blocking plate 310 and the upper blocking plate 320, and the coupling plate 420 is coupled to the insertion guide hole 124 of the lower cover 120 in a covering manner.

Figure 7:
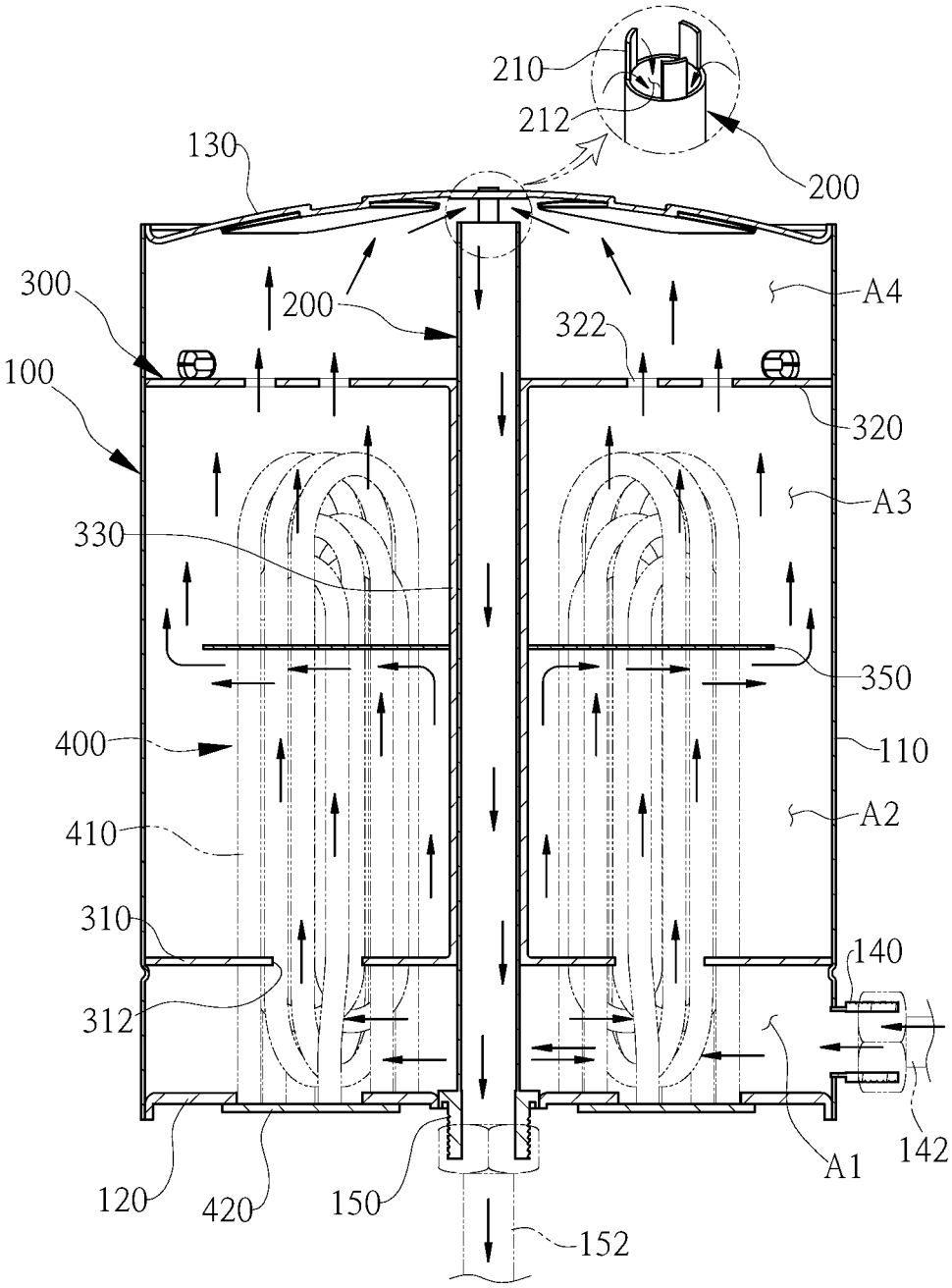
FIG. 7 is a view showing schematically operation of the instantaneous water heater having the guide part according to the exemplary embodiment of the present invention.

FIG. 7 is a view showing schematically operation of the instantaneous water heater having the guide part according to the exemplary embodiment of the present invention.

Referring to FIGS. 2 to 7, in the instantaneous water heater 1000 having the guide part according to the exemplary embodiment of the present invention, an inlet tube 142 is mounted to the inlet 140 and an outlet tube 152 is mounted to the outlet 150. The inlet tube 142 allows direct water to be supplied from the outside to the inside of the housing and the outlet tube 152 discharges hot water supplied from the supply tube 200 to a bathroom and the like. Furthermore, the inlet tube 142 may be provided with a flow control valve (not shown) and a flow sensor (not shown) to control a rate of introduced direct water, thus it is possible to control a flow rate of direct water introduced into the main body 110, and to control operation of the heater 400 by sensing a flow of direct water. The outlet tube 152 may be provided with a temperature sensor (not shown) sensing the temperature of discharged hot water, thereby controlling the operation of the heater 400. The flow control valve, the flow sensor, and temperature sensor are provided as general configurations, so detailed descriptions thereof will be omitted.

When direct water is introduced through the inlet tube 142, the direct water is guided to a space between the lower blocking plate 310 and the lower cover 120, that is, to a preparatory area A1. In the preparatory area A1, the direct water is heated to low temperature water by a portion of the heater 400 positioned in the preparatory area A1. Then, when the low temperature water passes through the coupling hole 312, the low temperature water is guided to a space between the guide plate 350 and the lower blocking plate 310, that is, to a first partitioned area A2. In the first partitioned area A2, the low temperature water is heated to middle temperature water at the temperature higher than the low temperature water by a portion of the heater 400 positioned in the first partitioned area A2. Next, when the middle temperature water passes through the guide groove 356 of the guide plate 350, the middle temperature water is guided to a space between the guide plate 350 and the upper blocking plate 320, that is, to a second partitioned area A3. In the second partitioned area A3, the middle temperature water is heated to high temperature water at the temperature higher than the middle temperature water by a portion of the heater 400 positioned in the second partitioned area A3. Finally, the high temperature water passing through a movement guide hole 322 is guided to a space between the upper blocking plate 320 and the upper cover 130, that is, to a supply guide area A4. The high temperature water is guided to the inside of the supply tube 200 through the supply portion 212 of the supply tube 200 and then is discharged through the outlet 150.

As described above, the instantaneous water heater of the present invention is provided with the guide plate 350 between the lower blocking plate 310 and the upper blocking plate 320. Thus, the space between the lower blocking plate 310 and the upper blocking plate 320 is partitioned into the first partitioned area A2 and the second partitioned area A3. Accordingly, as the low temperature water is heated into the middle temperature water by staying in the first partitioned area A2 and then the middle temperature water is heated into the high temperature water by staying in the second partitioned area A3, direct water can be heated into hot water at the temperature desired by a user.

Although the preferred embodiment of the present invention has been described for illustrative purposes, it is natural that the present invention is not limited thereto. Those skilled in the art will appreciate that various modifications, additions and substitutions are possible, without departing from the technical spirit of the present invention, and when the modifications, additions and substitutions are included within the scope as disclosed in the accompanying claims, the technical spirit should also be regarded as belonging to the present invention.

The invention claimed is:

1. An instantaneous water heater having a guide part, the instantaneous water heater comprising:

a housing having a space part therein, the housing having an inlet and an outlet provided at a lower portion thereof, respectively;

a supply tube configured as a vertically long tube, the supply tube being provided at a center portion of the space part in a vertical direction, and configured such that a lower end thereof is connected to the outlet;

a blocking member, wherein a pair of blocking plates is arranged at an upper portion and a lower portion of the space part by being spaced apart from each other and is configured such that the supply tube passes therethrough, a plurality of partition plates is arranged radially around the supply tube, which is positioned between the pair of blocking plates, in directions toward an inner circumferential surface of the housing, the plurality of partition plates being configured such that upper and lower ends thereof are connected perpendicularly to the pair of blocking plates, and a guide plate is provided between a pair of adjacent partition plates to be parallel with the blocking plates; and a heater positioned in a space between a pair of adjacent partition plates and configured to pass through the guide plate, wherein the pair of blocking plates includes a lower blocking plate positioned in the lower portion of the space part and an upper blocking plate positioned above the lower blocking plate, when direct water is introduced through the inlet that is positioned between a lower end of the housing and the lower blocking plate, the direct water is heated into hot water while passing through a first partitioned area between the lower blocking plate and the guide plate and a second partitioned area between the guide plate and the upper blocking plate, sequentially, and then the direct water is guided to an upper end of the supply tube that is positioned between the upper blocking plate and an upper end of the housing.

2. The instantaneous water heater of claim 1, wherein the guide plate comprises: a center portion through which the supply tube passes; and a plurality of protruding plates extending radially outwards from the center portion in the directions toward the inner circumferential surface of the housing, the guide plate being configured such that the partition plates pass through the protruding plates, and a recessed guide groove is formed between a pair of adjacent protruding plates to guide the heater.

3. The instantaneous water heater of claim 1, further comprising:

a cylindrical cover tube provided to cover an outer circumferential surface of the supply tube that is positioned between the upper and lower blocking plates, wherein an upper end of the cover tube is connected to the upper blocking plate and a lower end of the cover tube is connected to the lower blocking plate, an inner side of each of the partition plates facing the cover tube is connected to the cover tube and an outer side of each of the partition plates facing the inner circumferential surface of the housing is connected to the housing, a plurality of movement guide holes is formed on the upper blocking plate, and a coupling hole is formed on the lower blocking plate, with an area of the coupling hole being larger than a cross-sectional area of the heater so that the heater is inserted thereinto.

4. The instantaneous water heater of claim 1, wherein a plurality of protrusions is formed around an upper circumference of the supply tube by protruding and is configured such that upper ends of the protrusions are coupled to the upper end of the housing, and hot water introduced into a space between the upper blocking plate and the upper end of the housing is guided to an inside of the supply tube through a supply portion positioned between adjacent protrusions.

5. The instantaneous water heater of claim 1, wherein the housing having open upper and lower portions comprises: upper and lower covers configured to cover the open upper and lower portions, respectively; and a sliding rail provided on the inner circumferential surface of the housing such that when the plurality of partition plates is inserted into the housing having the open upper or lower portion, an outer side of each of the plurality of partition plates that faces the inner circumferential surface of the housing is slidingly inserted into the housing by being engaged with the sliding rail.

6. The instantaneous water heater of claim 1, wherein the housing having open upper and lower portions comprises: upper and lower covers configured to cover the open upper and lower portions, respectively; and an upper locking protrusion and a lower locking protrusion formed by protruding on the inner circumferential surface of the housing at a position facing an upper outer circumference of the upper blocking plate and at a position facing a lower outer circumference of the lower blocking plate, so that, when the upper and lower blocking plates are inserted into the housing having the open upper or lower portion, the upper blocking plate is locked by the upper locking protrusion and the lower blocking plate is locked by the lower locking protrusion.

7. The instantaneous water heater of claim 1, wherein the housing having open upper and lower portions comprises an upper cover and a lower cover configured to cover the open upper and lower portions, respectively, the lower cover comprises an insertion guide hole at a position facing the heater, and the heater comprises: a plurality of heating tubes positioned in a space between a pair of partition plates and formed in upside-down U-shapes; and a coupling plate positioned to cover the insertion guide hole and configured such that ends of the heating tubes are inserted thereinto.

* * * * *